United States Patent [19]

McKee et al.

[11] 4,027,521

[45] June 7, 1977

[54] APPARATUS FOR MAKING TERMINAL CONNECTORS

[75] Inventors: William H. McKee, West Covina, Calif.; Anthony E. Schubert, Villa Park, Ill.

[73] Assignee: TRW Inc., Elk Grove Village, Ill.

[22] Filed: Jan. 9, 1976

[21] Appl. No.: 647,799

Related U.S. Application Data

[62] Division of Ser. No. 545,353, Jan. 30, 1975, abandoned.

[52] U.S. Cl. ..... 72/404; 29/629; 72/385; 72/412; 72/472; 113/119

[51] Int. Cl.[2] ..... B21D 13/02

[58] Field of Search ..... 72/335, 379, 380, 381, 72/383, 385, 404, 405, 412, 472, 474, 475; 113/119, 116 V, 116 Y; 29/203 D, 630 A, 629

[56] References Cited

UNITED STATES PATENTS

| | | | |
|---|---|---|---|
| 2,186,288 | 1/1940 | Gallagher | 72/385 |
| 3,340,719 | 9/1967 | Kandle | 72/385 |
| 3,664,170 | 5/1972 | Davis | 72/385 |
| 3,748,889 | 7/1973 | Miller | 72/385 |

*Primary Examiner*—C.W. Lanham
*Assistant Examiner*—Gene P. Crosby
*Attorney, Agent, or Firm*—Neuman, Williams, Anderson & Olson

[57] ABSTRACT

Forming of wire contacting jaws for a channel type electrical terminal of conductive sheet metal is disclosed, without diminishing the length of the terminal, by first obtaining a stretching of the conductive metal into a preliminary displaced configuration in a first die. Then in a second die, reverse forming and coining the metal into a jaw formation deeper and narrower than the first configuration. Then in a third die, substantially removing the reverse curvature, with added coining and stretching of the metal, into a final jaw formation which is deeper and narrower than that obtained in the second die, without rupture of the metal. Slight reverse curvature is retained adjacent the juncture of the sides of the jaw with the body of the terminal.

2 Claims, 11 Drawing Figures

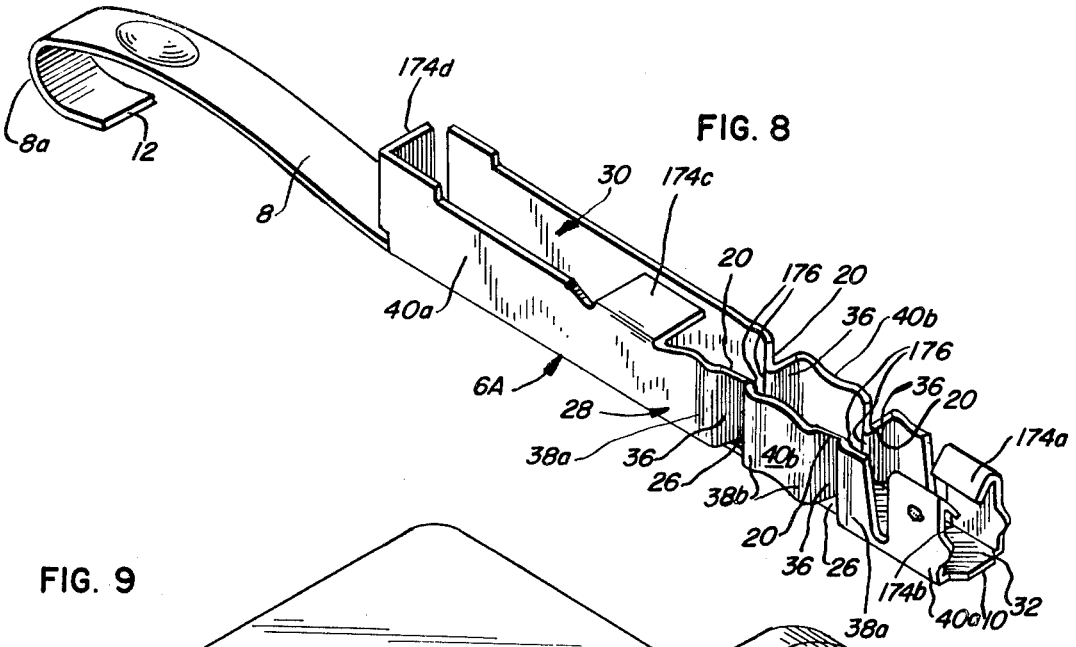
FIG. 8
FIG. 9
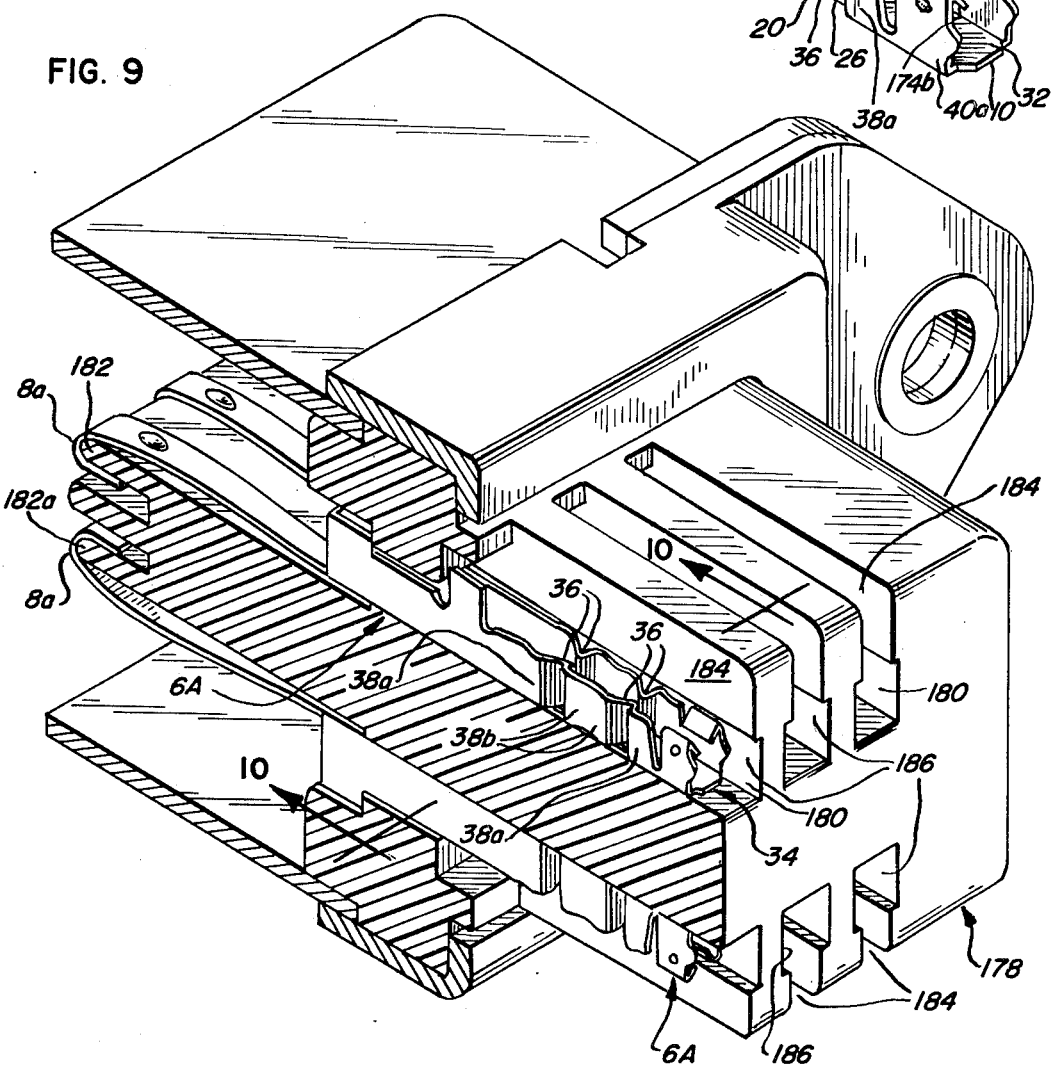

APPARATUS FOR MAKING TERMINAL CONNECTORS

This is a division of application Ser. No. 545,353 filed Jan. 30, 1975, now abandoned.

This invention relates to wire termination systems in which a wire to be held in a terminal may be held between a pair of jaws or within sets of jaws. More especially it relates to a method of forming generally U-shaped jaws in a terminal without shortening the original terminal blank and without rupturing the metal used therefor.

Terminal connectors of the type presently involved are formed of highly conductive metal which typically is shaped to provide an elongated channel. Insulation piercing jaws are provided within and along the edges of the channel, as disclosed more specifically in McKee and Witte application Ser. No. 443,678, filed Feb. 19, 1974, and McKee application Ser. No. 443,730, also filed Feb. 19, 1974, now U.S. Pat. No. 3,902,154. In use, an insulated wire is forced into the channel so that the jaws penetrate the insulation and forcibly contact the conductor of the wire.

Terminals of the type here involved typically are used where space is at a premium and miniturization is important, as in molded, insulating receptacles designed to contain a large number of terminals. A primary example is in connectors for 50-wire telephone cables. In such receptacles the tolerances are close, frequently on the order of just a few thousandths of an inch. In order to accommodate such tolerances it has been recognized that the terminals must be of precise uniform dimensions.

The dimensional accuracy is important to insure proper configurations and spacings for very high reliability of forming good electrical contact of the jaws with the conductor of the inserted wire. High compressive strength of the jaws also is important to maintaining the spacing tolerances under the compressive stresses imposed by forcibly inserting a wire when forming a termination, i.e., to avoid compressive yielding or failure of the jaws. The compressive stresses may be of a high order, as in relying upon a camming or wedging action between the wire and the jaws to effect an intimate gas-tight contact therebetween, and which may involve forcible displacement or distortion of the material of the wire conductor by that action. It is also desirable to maintain the side and bottom walls integral with one another, and to avoid deformation of the bottom wall which would increase the required overall depth of the terminal.

All of the foregoing problems and requirements are exacerbated by the small size of the terminals involved. Thus there is very little material available for forming the necessary configurations or to lend mechanical strength. These factors require close adherence to designs providing high stress capabilities relative to the inherent strength of the material available, including the geometry of the designs. Finally, highly conductive materials must be used in such terminals to maximize conductivity. However, practical and economical materials meeting these parameters usually are of low ductility and more particularly have a low to medium elongation capability, e.g., 5 to 10%. This means that the materials will not accommodate significant tensile stretching without tensile cracking and failure.

It is an object of this invention to provide methods for forming terminals of the aforementioned type, and which methods overcome the noted problems and meet the related desirable parameters.

It is a further object of this invention to form a plurality of such jaws in an improved electrical terminal, which jaws are oppositely disposed to each other.

It is a further object of this invention to form such contacting jaws as continuous portions of the sides of the terminal bodies, and particularly without corresponding deformation of joined portions of the terminal and without stress cracking or failure of the conductive material of which the jaws are formed.

Still a further object of this invention is to form the contacting jaws by means of a stamping die or a series of stamping die faces while maintaining close dimensional tolerances of the completed terminals.

A related object of this invention is to provide a progressive die including a plurality of ribs and valleys on the faces thereof in which the jaws of the terminals may be formed.

Another related object of this invention is to provide an improved die blank of current conducting metal for forming a plurality of electrical terminals in a progressive die, each terminal including a plurality of shoulders in the sides thereof arranged along side depressions therein for forming wire contacting jaws within the bodies of the terminals.

These and yet additional objects and features of the invention will become apparent from the following detailed discussion of an exemplary embodiment, and from the drawings and appended claims.

In a preferred form of the present invention a method of forming wire contacting jaws in an electrical wire terminal is provided wherein the terminals are formed of a sheet of electrically conductive metal. A first jaw-forming portion of the sheet is separated from the remainder of the sheet along a substantial part of opposed edges of that portion, and remains joined to the sheet at its opposite ends. The sheet is continuous between those ends externally of that portion, as well as within that portion. The first portion, thus associated with the sheet, is deformed laterally of the sheet to form a contact jaw without any corresponding deformation of the joined, continuous part of the sheet. The described first portion of the sheet is drawn throughout its width into a broad shallow wave form extending on one side of the sheet so that the wave form has a first base width. Then the opposite end portions of the first portion within the base width are reformed to be curved in a direction opposite to that of the center of the wave form, thus positioning the opposite end portion curves on the opposite side of the sheet from the center of the wave form, while the center segment of the wave form remains disposed in its original direction and obtains a reduced radius. Subsequently, further forming of the first portion takes place by returning the end portions toward the plane of the sheet while extending the center segment further outwardly from, and on its original side of, the sheet, and further reducing the radius of curvature of the center segment. By particular controlling of the forming of the material to the final jaw configuration, including coining certain portions in the second and third steps and spreading the stretching of the metal over a maximum length while avoiding concentrated stretching, a dispersed elongation of the metal in the first portion is obtained while forming a jaw of a narrow, sharp, desirable configuration. The described formation of the jaws may be obtained by manipulating the sheet on a set of die faces.

BRIEF DESCRIPTION OF THE DRAWINGS

For a complete understanding of this invention reference should be made to the accompanying drawings in which:

FIG. 8 is a perspective view of a completely formed terminal separated from the blank shown in FIG. 1, FIG. 9 is a perspective cross-sectional view of a plurality of terminals indicated to that shown in FIG. 8, mounted in a receptacle body frequently referred to as an insulating high density connector body.

DETAILED DESCRIPTION OF THE PREFERRED EMBODIMENT

Considering first FIGS. 1–7, the improved method of making a terminal for use in a wire termination system is illustrated by showing successive steps in the formation of the terminal. Such terminals are especially useful as solderless terminations in high density connectors, particularly those used in miniturized electrical and electronic components. It will be recognized that the metal used in the formation of such terminals, particularly those of the present invention, is quite thin but only slightly ductile. One especially suitable metal is a cadmium bronze alloy 961 in 0.006 inch sheets. Ordinarily the tensile strength of this material is on the order of 73,000 psi., and it has an elongation capability of about 6–8%, preferably with a minimum of 7%.

Figure 1:
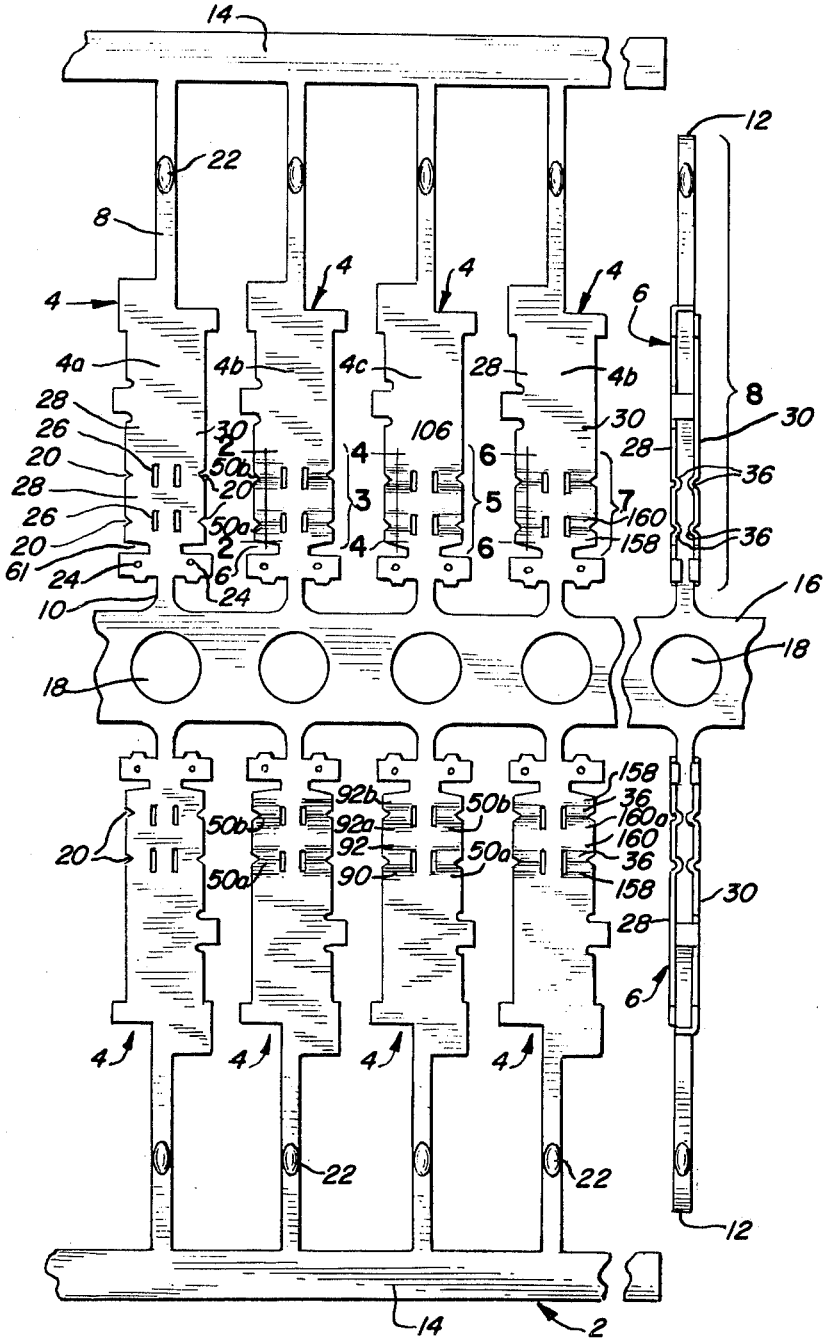
FIG. 1 is a top plan view of a section of a blank of a flat metal sheet for use on a progressive die and showing a series of terminals in various stages of formation.

FIG. 1 shows a series of terminal blanks of conductive metal on which successive steps of formation have been carried out in accordance with the present invention. A progressive die blank 2 is stamped to form foldable configurations such as the configuration 4 which are ultimately folded into terminals such as terminal 6. Sheet 2 may be as long as necessary to fit both the stamping operation and the terminal forming dies to be described later. Stems such as those shown at 8 and 10 maintain the foldable and folded configurations evenly disposed throughout the length of the metal blank. The stems 8 may be finally severed, as at stem end 12, from a strip 14 at the outer edge blank 2, and the stems 10 may similarly be severed from a strip 16 in the center of blank 2. A completely finished and separated terminal 6 is shown as 6A in FIG. 8.

As shown in FIG. 1, the center strip 16 of the metal blank 2 includes a plurality of regularly spaced apertures 18 which function as an indexing means for moving blank 2, including the foldable configurations 4, between terminal forming progressive die faces. It should be understood that although the foldable configurations 4 are illustrated in FIG. 1 in individual and successively more finished form from left to right, it is possible to shape those configurations in groups having the same form so that groups of the configurations 4 would be shaped identically. In that event the blank would be advanced more rapidly in accordance with the spacings of the groups.

Also, it will be noted that FIG. 1 illustrates forming the foldable configurations 4 on both sides of the center strip 16 in blank 2. As viewed in FIG. 1, the configurations 4 below the strip 16 are exactly identical to those located immediately above them. Since the resulting terminals are used in large numbers (a 2⅛ inch long connector may contain as many as 50 terminals, for example), it is desirable to obtain high production rates. By duplicating the configurations, and the steps involved in making them, on each side of the metal blank 2, a number of terminals can be made very rapidly with a minimum number of movements of the metal blank and a correspondingly lesser unit cost.

Whether the apertures 18 or other indexing means are located along the center portion of blank 2 or along one edge thereof, it is important that the metal blank 2 remain the same width throughout as the blank progresses through the equipment for forming the terminals. Uniform width and lack of distortion of the blank in this respect insures that the shearing of the edge strips 14 and center strip 16 from the stems 12 and 10 will result in finished terminals of uniform dimensions. Such uniformity can be achieved notwithstanding the formation of several impressed undulations in the sides of the terminals, shortly to be described. Formation of such undulations would be expected to rupture the material or to cuase deformation of parallel connected flat portions of the blank. The former of course is unacceptable and the latter would pull the outer edge portions 14 of the blank closer together, or distort the uniform linear configuration of the center strip 16, and not only create a substantial number of variations in the width of the blank but also disturb the uniform orientation of the components of the terminals themselves.

The impression of the undulations just referred to, and to which the present invention is directed, is particularly illustrated at FIGS. 2–7, but is best perceived with reference to the foldable configuration of the blank 4*a* in FIG. 1 and the completely finished terminal 6A in FIG. 8. Configuration 4*a* includes notches 20 and is flat except for impressions and protuberances 22 and 24 which are not directly involved in the present invention. Configuration 4*a* is formed as the result of preceding stamping steps performed upon the flat metal blank 2. Also included in configuration 4*a* are slots 26 (which alternatively may be sheared slits, without removing material) and which are preferably formed in pairs opposite the notches 20, so that each notch is disposed along the edge of the foldable configuration pointing at approximately the midpoint of a companion severance 26. The portions of each blank 4 comprising the sections between the slots 26 and the respective blank edges together with adjoining sections at each end of those sections are formed into jaws in accordance with this invention.

The end result of the desired shaping of configuration 4*a* is shown in FIG. 8, a completed terminal 6A ready for installation in a receptacle body such as an insulating high density connector body. The stem ends 10 and 12 have been appropriately severed, as by shearing, from the metal blank 2. Side or panel portions 28 and 30 of the terminal have been folded into upright parallel positions, at approximately right angles to a terminal body base panel 32, thus forming a narrow channel body 34 extending longitudinally of the terminal. The notches 20, which have been beveled, are disposed along the top edges of the sides 28 and 30, and slots 26 are disposed at the bottom edges at the junctions of the sides with the terminal body base 32. The jaws 36 extend into the channel for contacting the electrical conductor of a wire to be disposed within the channel. Shoulders 38*a* are provided at the junctures of the outer edges of the jaws 36 with nominally planar portions 40*a* of the sides, and shoulders 38*b* are formed at the junctures of the inner edges of the jaws with yoke portions 40*b* of the sides intermediate the jaws.

Figure 10:
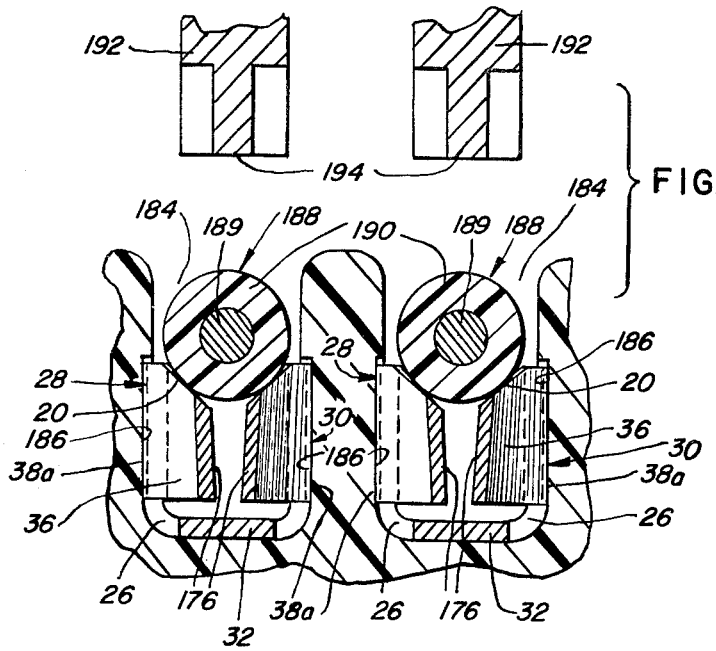
FIG. 10 is a cross-sectional and elevational view of a pair of terminals identical to the terminal shown in FIG. 8 taken along the line 10—10 in FIG. 9 and including a pair of insulated conductor wires, not shown in FIG. 9, disposed for insertion into the terminals.
Figure 11:
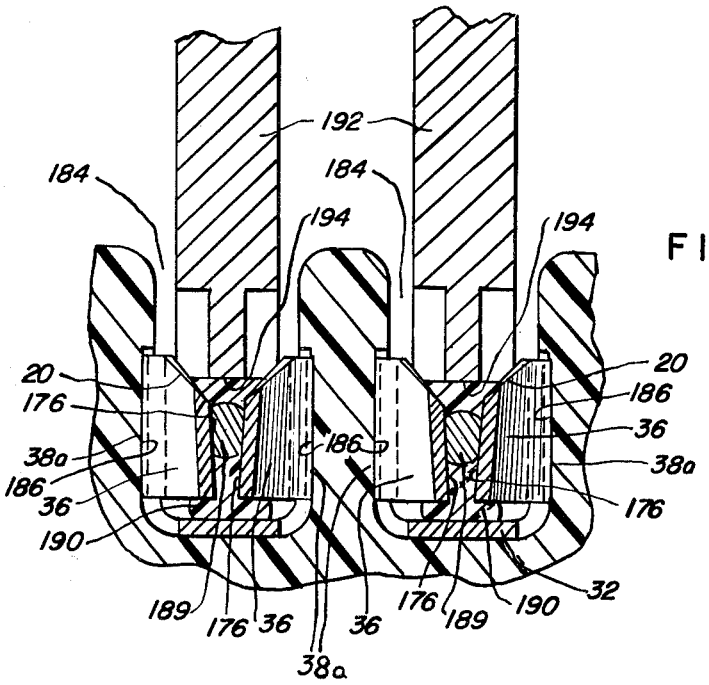
FIG. 11 is a cross-sectional and elevational view of the pair of terminals shown in FIG. 10 illustrating insertion of the wires into the terminals.

By way of a more specific illustration, in a terminal 6A for use in telephone wire connectors and in the production of which this invention is particularly advantageous, the channel body is about 0.050 inches wide (outside dimension), about 0.058 inches high and about 0.40 inches long from the outside of tab 174*d* to the near end as seen in FIG. 8. Such terminals are formed of the aforementioned 0.006 cadmium bronze alloy sheets and are used in a solderless ribbon-type miniature connector made and sold by TRW Inc., Elk Grove Village, Illinois. Two pairs of opposed jaws 36 are provided on 0.080 inch centers in each terminal, with each jaw being about 0.022 inches deep from the outside surface of the respective channel side. Each jaw is about 0.007 inches outside radius at the inner nose, and about 0.030 inch wide between the centers of curvature of the junctions between its legs and the respective side panel, which curves are of about 0.006 radius. Each jaw is beveled at the top end and tapers inward slightly therebelow, as seen in FIGS. 8, 10 and 11. Each slot 26 is 0.040 inches long and separates the respective jaw from the base panel 32.

Figure 2:
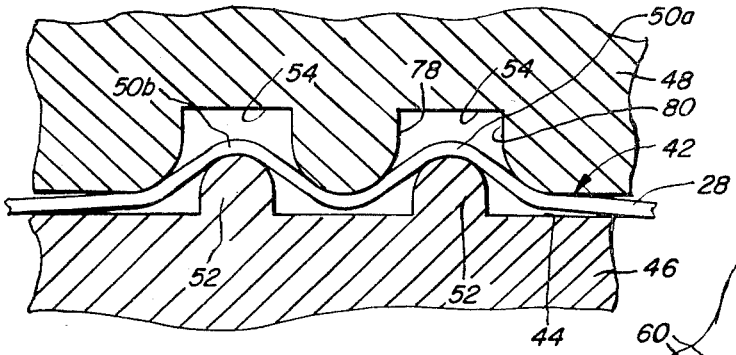
FIG. 2 is a cross-sectional view of a portion of the blank shown in FIG. 1, taken along the line 2—2 in FIG. 1, disposed between a first ribbed die and a first mating die.

The forming of the jaws 36 is accomplished in steps which result in successive forms of the jaw-forming portions of the blanks as shown by the blanks 4*b*–4*d* in FIG. 1 and illustrated cross-sectionally and in perspective in FIGS. 2–7. In FIG. 2 a portion of the side 28 of foldable configuration 4*b* from which a pair of jaws 36 is to be formed as shown between a first ribbed die face 42 of a die 48 and a first mating die face 44 of a die 46. Both die faces are of configurations to include a plurality of ribs and valleys. When the dies are moved together (as in FIG. 2 as by raising or lowering the first die 46, depending upon orientation of the die faces) the intervening two jaw-forming portions of the blank are formed into two broad shallow depression or wave configurations 50*a* and 50*b* by first ribs 52 on the die face 44 and first valleys 54 in the die face 42. In this initial step the mating dies are not closed on the blank completely or "bottomed". The first depressions 50 are shaped such that the metal configuration 4*b* is not ruptured despite the fact that the material may have very limited elongation capabilities. One of the prime objectives of the first steps is to form each depression 50 as the beginning of a jaw by causing the metal to flow and stretch over the longest available length of material by a minimum degree of stretch in any one section without rupture of the material.

Figure 3:
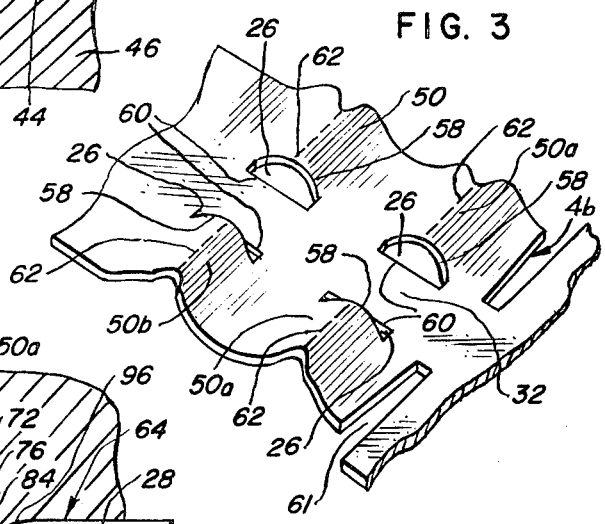
FIG. 3 is a perspective view of a broken away portion of the blank shown in FIG. 1, at approximately the cross-sectional portion shown in FIG. 2, but showing the full width of a terminal blank as indicated at bracket 3 in FIG. 1.

The initial shaping of the jaw portions of the blanks, in the manner just described, results in a blank with the shallow wave formations 56 of two depressions 50*a* and 50*b* as shown in FIG. 3 (see also the left side of configuration 4*b* in FIG. 1). These depressions extend the full width of the jaw-forming portions, and are raised or otherwise displaced from the plane of configuration 4*b*, distorting one edge 58 of each of slots 26 while leaving the other edges 60 generally co-planar with the terminal body base 32 which remains flat. The zenith or peak of each depression 50 is indicated by a dashed line 62 and is perpendicular to a vertical plane containing the principal longitudinal axis of the terminal body base 32. These peaks also coincide with the edges of the notches 20 at their deepest and closest penetration toward the distorted edges 58 of slots 26.

For the specific example given above, the shallow wave forms created in the preliminary shaping of the jaws may be obtained by using a die 46 having ribs 52 spaced on 0.080 inch centers, with outer ends of 0.015 inch radius and which protrude 0.20 inch from the otherwise generally flat face of the die. Corresponding valleys 54 may be 0.042 inch wide and 1/32 inch deep, with 0.019 inch radius shoulders at each side. It has been found by using dies having such dimensions and the cadmium bronze alloy metal to form a terminal, that there is some springback of the metal depressions 50 when the ribbed die and the mating die faces are separated. The depressions 50 are pressed to a depth such that, after being released from the dies, their inner depth is on the order of 0.010 inch i.e., 0.016 to 0.018 inch outer height measured vertically from the outer surface of their peaks to the opposite flat surface of the side panel.

By approaching the formation of jaws 36 gradually and over a maximum length, that is, by separately performing the first step of making shallow wave forms in the otherwise flat sides of the terminal blank in the manner just described, the side portions 28 of terminal 6A (FIG. 8) permit the creation of wave forms therein as demonstrated in FIGS. 2–3 without distortion or shortening of either the base 32 or of the remainder of the sides 28 and 30 despite the fact that the sides and base are integrally connected. Primarily, the wave forms (such as depressions 50) are obtained by dispersed stretching and inflow of metal from portions of the configuration 4*b* adjacent but beyond the ends of the sections between the notches 20 and slots 26, as well as by dispersed stretching within those sections. Some displacement of the portions of the blank intermediate the wave forms and the notches 61 (FIG. 1, and which portions are about 0.020 inch wide), apparently occurs as there is a change in the angle of the adjacent edge of this notch as the depressions 50 are formed, compare blanks 4b–4d with blank 4a. However, the same displacement is not available between the waves or at the opposite end, where all of the blank remains integral and the elongation must occur by stretching. The stretching is not concentrated and is relatively uniform throughout the metal being worked.

Figure 4:
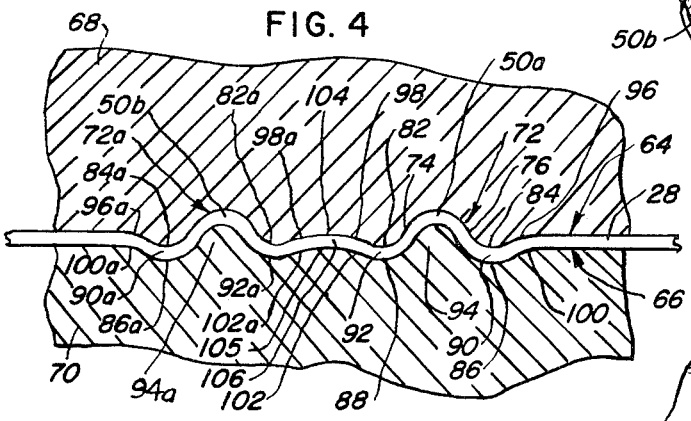
FIG. 4 is a cross-sectional view of a portion of the blank shown in FIG. 1, taken along the line 4—4 in FIG. 1, disposed between a second ribbed die and a second mating die.
Figure 5:
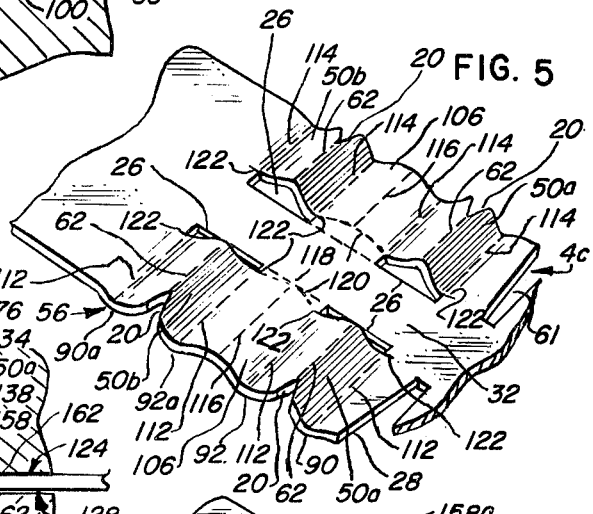
FIG. 5 is a perspective view of a broken away portion of the blank shown in FIG. 1, at approximately the cross-sectional portion shown in FIG. 4, but showing the full width of a terminal blank as indicated at bracket 5 in FIG. 1.

In examining the second step of creating jaws 36, attention should be given to FIGS. 4 and 5 as well as to configuration 4c in FIG. 1. The jaw-forming portions of the blank, after having undergone the initial forming step shown and described with respect to configuration 4b in FIGS. 2 and 3, are placed between a second ribbed die face 64 of a die 68 and a second mating die face 66 of a die 70. The blanks are located with the previously-formed depressions 50 centered on ribs and valleys of these die faces to be described. Preferably these dies are then fully closed ("bottomed") against the blank to reform and modify the preliminary shaping of the terminal side panel in the areas including the depressions 50, as shown for example in FIG. 4. Thereby, a number of significant modifications are made to reform the depressions toward their ultimate jaw form.

Referring to the die surfaces adjacent the depression 50a, as shown in FIG. 4, the die face 64 includes a second valley 72. The sides 74 and 76 of the second valley 72 converge toward each other as they extend into the body of die 68. At their outermost extremities, adjacent the face 64 of the second ribbed die, these sides are closer together than the sides 78 and 80 of each valley 54 as viewed in FIG. 2. At each of those extremities first shoulder ribs 82 and 84 are formed upon the second ribbed die face 64, extending outwardly beyond the generally flat plane of that die face. These ribs provide surfaces which cooperate with first shoulder receiving grooves 86 and 88 in the second mating die face 66 for forming shoulder impressions 90 and 92 in the blank 4c. Similarly, a rib 94 between the grooves 86 and 88 mates with the valley 72 for reforming the center segment of the depression 50a. The second valley 72 and rib 94 are so dimensioned that the depression 50a may be further deepened within valley 72 from the preliminary depth of that depression achieved between the first ribbed die face and the first mating die face 44.

In order to insure the reverse curvature (from the curvature formed at the depth of depression 50a) for the formation of shoulder impressions 90 and 92, the face 64 of the second ribbed die 68 may be provided with a shoulder return face portion 96 adjacent the outer extremity of rib 84. A similar shoulder return face portion 98 may be provided adjacent the outer extremity of shoulder 82. The shoulder return face portions 96 and 98 in die face 64, and cooperative shoulders 100 and 102 of the face 66, serve to return the adjacent portions of the respective side panel to its normal plane relative to the jaw deformations.

The described ribs, shoulders and valleys of die faces 64 and 66 are duplicated for reforming of the depression 50b in the same manner as described for depression 50a, as indicated by the parts identified by the same numerals with a subscript *a*. However, when it is desired to provide a plurality of jaws 36 in a side panel, as shown, the formation of the shoulder face portions 98 and 102 will be slightly varied from those of the face portions 96 and 100. As shown in FIG. 4, adjacent shoulder return face portions 98 and 98a in the face 64 of die 68 merge with an intervening arcuate section 104 intermediate shoulders 82 and 82a. The center of this section is substantially co-planar with the major face surface of die face 64. Such a section 104 is cooperation with a corresponding portion 105 of the die face 66 which merges with surfaces 102 and 102a provides for a wave formation 106 in the side panel between depressions 50a and 50b (which are to be finally formed into jaws 36). The center of this wave is maintained co-planar with the main body of the respective side panel.

The second mating die faces 64 and 66, as above described, preferably are adapted to be bottomed against the portions of blank 4c between those two die faces. Such bottoming insures proper formation of the various depressions and shoulders of the blank, which occurs by reforming the blank to the new configuration while coining and further stretching the metal in the work area, as described further below. At the same time, the remainder of the blank 4c is retained in a flat undistorted form between other flat portions of the dies.

The result of utilizing such complementary die faces as described with respect to FIG. 4 is shown in FIG. 5, albeit FIG. 5, like FIG. 3, illustrates the use of four sets of die faces rather than two sets. Since FIG. 5 shows merely a further step in the formation of terminal 6A (see FIG. 8), which step is a further development of the depressions shown in the fragmentary portion of the terminal illustrated in FIG. 3, it is only necessary to identify the particular changes which have occurred. Portions of each of the original depressions 50 have been reformed as shoulders 90 and 92, extending on the opposite side of the blank 2 from the central segments of depressions. The two sides of each depression 50 have been formed much closer together and the depressions themselves have been narrowed and deepened, with considerable reduction in the included angle defined between these sides.

Of primary importance is the fact that the terminal body base 32 has not been distorted or shortened in any manner. The length of slots 26 has remained unchanged but despite the increased length of the metal necessary for forming the depressions and adjacent shoulders, the metal has remained unruptured.

The manipulation of the metal in the jaw-forming portions to form the depressions and the shoulders in the step of FIG. 4 includes reforming or reshaping of the stretched wave form of FIG. 3. In addition, and simultaneously, controlled coining, that is, gradual, measured, compressive forming of the metal is effected in the areas comprising the shoulders 90, 90a, 92 and 92a as those shoulders are formed, along with some additional stretching of the metal throughout the portion being formed. The coining is effected in and adjacent the center portions or bends of the arcuate end configurations of the impressions 90, 90a, 92 and 92a, between the outer end of each rib 82, 82a, 84 and 84a and the respective opposed groove 86, 86a, 88 or 88a. The metal is caused to flow into the convolutions on the die faces under the influence of pressure exerted through the die faces thus providing reshaping of the metal and avoiding rupture of the metal during the necessary lengthening and bending of the respective portion of the blank to form the described configuration. Any substantial concentrated or uneven tensile stretching of the metal is avoided in order to obviate the possibility of tensile fracture or failure, particularly at the tips of the several bends created in the shoulder and depression curved portions.

The above-described second step achieves quite minute dimensions, especially in obtaining the reverse curvatures provided by the shoulders in each side of each initial depression 50. Whereas, in forming the depression 50 initially (see FIG. 2), the first rib 52 on the first mating die face 46 may impress each depression 50 into a valley 54 which measures 0.042 inch wide even at its deepest pont, in the second, coining step (see FIG. 3), each depression 50 may be impressed into a valley 72 which may measure only about 0.025 inch where left and right sides 74 and 76 join shoulders 82 and 84, respectively.

Depressions 50*a* and 50*b*, as viewed in FIG. 5, include convex curvatures having their peaks along zenith lines 62. Looking at the same face of sides 28 and 30, reverse, or concave, curvatures are formed at the shoulders 90, 92, 90*a* and 92*a* which extend from the outside edges of the jaw-forming portions 50*a* and 50*b* to the slots 26. The nadirs of these shoulders are approximately aligned with the ends of the slots 26, as illustrated by dashed lines 112 and 114. A dashed line 116 designates the zenith of the arcuate wave formation 106 intermediate the shoulders 92 and 92*a*, which zenith extends perpendicularly toward an imaginary line 118 aligned with the inside edges of slots 26. The section 106 extends between an imaginary line 120 approximately at the outside edges of slots 26 to the outer edge of the panels and is shaped to present a convex surface on the same face of side 28 as the convex surfaces of depressions 50, with the outer edges leading downward to the shoulder ribs 92–92*a*. Creases at 122 accommodate the offset of the outer portions of shoulders 90, 90*a*, 92 and 92*a*.

The die faces 64 and 66 are of configurations and dimensions to extend the overall height of the jaw-forming portions to slightly greater than 0.018 inch when in the dies as in FIG. 4, as measured from the peaks of portions 50 to the opposite peaks of shoulders 90 and 92. Due to springback of the material, this height is about 0.018 inch in the blank 4*c* of FIG. 5.

In addition to dimensions already noted, a set of specific dimensions for die faces 64 and 66 for the specific example referred to above includes locating the valleys 72–72*a* and ribs 94–94*a* on 0.080 inch centers. The valleys 72 and 72*a* may be of a 0.0135 inch radii with their uppermost surfaces 0.007 inch above the major flat surface (die line) of die face 64, and each shoulder or rib 82, 82*a*, 84 and 84*a* may be of 0.0076 inch radius with its peak 0.007 inch below the die line. The shoulders 96, 96*a*, 98, 98*a* and intervening surface 104 all may be of 0.025 inch radii, and are tangent at their upper edges with the major flat surface (die line) of die face 64. The centers of curvature of shoulders 82–84 and 82*a* and 84*a* are spaced 0.020 inch on the respective sides of the centerlines of valleys 72 and 72*a*. Surface 104 is a continuation of the curvature of shoulders 98 and 98*a* and has its centerline midway between the centerlines of the valleys. These various arcuate surfaces merge directly with one another at common tangent lines on the side of each rib, shoulder and valley. Referring to die face 66, each rib 94–94*a* may be of 0.0076 inch radius with its outermost peak 0.007 inch above the major plane of the respective die face. The valleys 86, 86*a*, 88 and 88*a* may be of 0.0135 inch radii, each having its center of curvature spaced 0.020 inch on the respective side of the centerline of the related rib and each extending 0.005 inch below the plane of the die face 66. Shoulders 100 and 100*a* are of 0.019 inch radii and surface 105 is of 0.024 inch radius including shoulder surfaces 102 and 102*a*, with each of these surfaces extending tangent to the major plane of die face 66. These various arcuate surfaces also merge directly with one another at common tangent lines.

Figure 6:
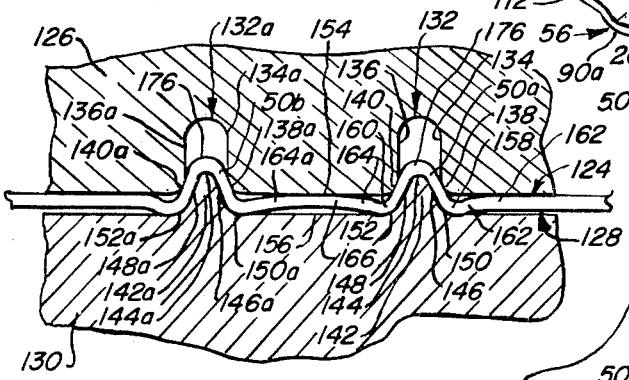
FIG. 6 is a cross-sectional view of a portion of the blank shown in FIG. 1, taken along the line 6—6 in FIG. 1, disposed between a third ribbed die and a third mating die.
Figure 7:
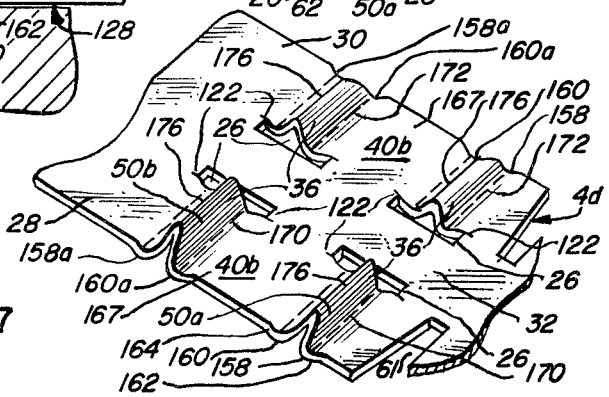
FIG. 7 is a perspective view of a broken away portion of the blank shown in FIG. 1, at approximately the cross-sectional portion shown in FIG. 6, but showing the full width of a terminal blank as indicated at bracket 7 in FIG. 1.

As outlined above, FIGS. 2 and 3 illustrate a preferred initial step in the process of forming terminals 6A, while FIGS. 4 and 5 illustrate a preferred intermediate step in forming such terminals. FIGS. 6 and 7 illustrate a preferred third step of terminal formation prior to folding the sides of a processed configuration 4 into a completed terminal 6A.

In FIG. 6 a third ribbed die face 124 of third ribbed die 126 is opposed by a third mating die face 128 of third mating die 130. The processed portion of configuration 4*c* shown in FIG. 5 is positioned between the faces of the third dies and is further formed thereby as in FIG. 6 to produce the configuration 4*d* as shown in FIG. 7. Similarly to the first processing step illustrated in FIG. 2, but contrary to the intermediate processing step illustrated in FIG. 4, the dies 126 and 130 are not fully bottomed in the third processing step illustrated in FIG. 6.

The ribbed die face 124 includes a third valley 132 having opposite sides 134 and 136 which are generally parallel to each other. Curved second shoulder ribs 138 and 140 connect the major planar portions of the die face 124 with the sides 134 and 136, respectfully, of the third valley. Otherwise the face 124 of the third ribbed die adjacent valley 132 lies almost entirely in the same horizontal plane. The valley 132, and more particularly the shoulders 138 and 140, is adapted to receive and further shape depression 50*a* following the processing of such depression between die faces 68 and 70 as in FIG. 4. When it is desired to simultaneously process a plurality of adjacent depressions, such as depressions 50*a* and 50*b*, a further third valley 132*a* identical to valley 132 may be disposed in the third ribbed die face 124. Like third valley 132, third valley 132*a* includes opposite sides 134*a* and 136*a* which are parallel to each other. Curved second shoulder ribs 138*a* and 140*a* connect portions of the die face 124 with the sides 134*a* and 136*a*, respectively, of third valley 132*a*.

The third mating die face 128 includes a third rib projection 142 which has a rounded but much more sharply pointed tip portion 144 than the end of rib 94 on the second mating die face 66, shown in FIG. 4. Rib porjection 142 is adapted to press depression 50 (see FIG. 6) between the narrowly spaced apart second shoulder ribs 138 and 140 of the third ribbed die face 124, whereby those shoulders press and coin the sides of the depression against the sides of the rib 142. The third rib projection 142 also extends much further outwardly from third mating die face 128 than does rib 94 of the second mating die face. Accordingly, a depression 50 is further deepened, or elongated, between the third die faces 124 and 128. A similar rib porjection 142*a* may be formed on mating die face 128, spaced apart from rib projection 142, when it is desired to process a plurality of depressions, such as 50*a* and 50*b* in configuration 4*d* (see FIG. 1).

Face 128 of the third mating die 130 further complements face 124 of the third ribbed die 126 in that the sides of the third rib projection 142, namely, right side 146 and left side 148, as viewed in FIG. 6, are, for most of their length, closer together than the sides 134 and 136 of valley 132. This relationship is maintained even though sides 146 and 148 angled toward each other as they approach tip portion 144 of the third rib projection 142, while sides 134 and 136 of valley 132 are substantially parallel. Second shoulder receiving curvatures 150 and 152 are situated at the extremities of the sides 146 and 148, respectively, of the third rib projection 142, and these second shoulder receiving curvatures merge with sides 146 and 148 at common tangent lines where rib 142 is narrower than the valley 132 by an amount exceeding twice the thickness of the sheet material being formed, i.e., the total width of the rib 142 at this level plus a thickness of the material on each side would be less than the width of valley 132. The surfaces 150 and 152 curve outward from these merge areas and are tangent with the major planar surface of face 128 as illustrated.

When it is desired to process a plurality of depressions, such as 50*a* and 50*b* (see FIG. 6), the third rib projection 142*a* is formed with sides 146*a* and 148*a*, and second shoulder receiving curvatures 150*a* and 152*a*, disposed identically with respect to valley sides 134*a* and 136*a* and second shoulder ribs 138*a* and 140*a*, as the rib projection sides and shoulder receiving curvatures of rib 142 are disposed relative to valley 132.

As suggested above in describing the third ribbed die face 124 as being almost entirely in the same horizontal plane, the face 128 of the third mating die 130 also lies almost entirely in a horizontal plane, thus further complementing the third ribbed die face 124 and the valleys and shoulders formed therein. The disposition of the third ribbed die face 124 and third mating die face 128 in horizontal planes may correlate two yoke forming portions on these die faces, i.e., when a plurality of depressions are to be formed, a planar yoke-forming face portion 154 on die face 124 joins the second shoulder rib 140 adjacent valley 132 with the further second shoulder rib 138*a* adjacent valley 132*a*, and an oppositely disposed planar yoke-receiving face portion 156 on the third mating die face 128 joins the second shoulder receiving curvature 152 adjacent rib projection 142 with the further second shoulder receiving curvature 150*a* adjacent rib projection 142*a*.

Relative to the dimensions of the die faces set forth above with respect to the first ribbed and first mating dies 48 and 46 and with respect to the second mating dies 68 and 70, the faces of the third ribbed die and the third mating die may be dimensioned as follows. The valleys 132 and 132*a* and the ribs 142 and 142*a* are spaced 0.080 inch on centers. Both of the valleys 132 and 132*a* extend inwardly into the third ribbed die face 1/32 inch, and their sides 134 and 136 as well as 134*a* and 136*a* are parallel to one another and disposed 0.017 inch apart. Each of the second shoulders 138, 140, 138*a* and 140*a* has a radius of 0.006 inch. In a complementary manner, the third mating die face 128 is dimensioned so that each of the rib projections 142 and 142*a* extends outwardly from die face 128 a distance of 0.016 inch. The radius of each of the tip portions 144 and 144*a* is 0.002 inch and the sides 146 and 148 for projection 142 and 146*a* and 148*a* for projection 142*a* diverge inward from the lines of tangency with the rounded tip portion of each projection toward the horizontal plane of the face 28 of the die, defining an included angle of 40° bisected by a line normal to face 128. Each of the shoulder-receiving curvatures 150, 152, 150*a* and 152*a* is of 0.010 inch radius, and the centers for each pair of these curvatures are symmetrically disposed about the centerline of the respective rib and are spaced apart 0.029 inch. Using such dimensions for the face of die 130, the yoke-receiving face portion is 0.051 inch between the centers of the shoulder-receiving curvatures 152 and 150*a*.

In the third step for further forming the jaws 36, die faces 124 and 128 are engaged with a configuration 4*c* i.e., a portion of side 28 previously processed as illustrated in FIGS. 4 and 5 and subsequently positioned between die faces 124 and 128. These two die faces then are closed on the blank as in FIG. 6, but the dies preferably are not bottomed.

Since substantially the same forming action occurs in and around the second depression 50*b*, it is only necessary to specifically describe the third step in forming of depression 50*a*. The primary stress points are in the areas of engagement of the terminal blank between the second shoulders 138 and 140 of ribbed die face 124 and the second shoulder-receiving curvatures 150 and 152 of the mating die face 128, as illustrated with some exaggeration in FIG. 6, and in the engagement of tip 144 in the apex of the depression 50*a*. Coining of the metal takes place in the side shoulder stress areas, between the shoulders 138–140 and the curvatures 150–152, apparently along with some further stretching of adjacent portions of the blank, to provide additional length in the jaw-forming portion for further deepening and for narrowing of the depression 50*a*. Moreover, these areas of coining are shifted slightly inward and upward of the shoulders 90 and 92 from the coining of the preceding step, and the stretching is distributed, to avoid tensile rupture of the metal. Simultaneously there is further stretching and further forming of the metal over the nose 144 to further distribute the stretching and further forming stresses, i.e., in extending the depression around tip portion 144 of the third rib projection 142. In the latter regard, it will be noted that the rib 142 is slightly higher (0.016 inch) than the vertical dimension of the depression 50*a* of the blank 4*c* resulting from the preceding step. Allowing for some springback of the metal used, the depression 50*a* is lengthened to approximately 0.022 inch (outside height dimension) in the blank 4*d*.

Because die faces 124 and 128 are not completely bottomed, shoulders 90 and 92 of blank 4*c* are not completely eliminated in the further forming of blank 4*d*, but remain in part as slight residual shoulder ridges 158 and 160 (FIGS. 6 and 7) of the configuration of final shoulder forms 38*a* and 38*b* (FIG. 8). Correspondingly, neither are the shoulder return portions completely eliminated, since they are pressed into the modified, final forms 162 and 164 of side 28. When more than one depression in side 28 is desired, the wave formation 106 of blank 4*c* (FIG. 5) is substantially flattened to form yoke 166 (FIGS. 6 and 7) between the terminuses of shoulder return portion 164 and an adjacent shoulder return portion 164*a* associated with depression 50*b*. In the preferred form of the terminal forming process or method of the present invention, described above in terms of the dimensions of dies used in the specific illustrative process, the distance between the outermost surfaces of the shoulders 158 and 160 and the corresponding outer face plane of yoke 166 and the remainder of side panel 28 will generally be only a few thousandths of an inch in the blank 4*d* (FIGS. 6 and 7) and in the ultimate folded form of terminal 6A (38*a* and 38*b* in FIG. 8).

It should be particularly noted that in the further forming of blank 4*d* from blank 4*c*, as described with reference to FIG. 6, not only is each depression 50 deepened, but also its sides are brought closer together and straightened somewhat, more nearly approaching positions normal to the plane of the respective side panel 28 or 30. Correspondingly, the shoulders at the base of each depression 50 are formed closer together and their radii of curvature reduced, thereby minimizing the distance between their nadirs or support peaks, i.e., the shoulder ridge surfaces opposite the dashed lines 170 and 172 in FIG. 7. The net result is to provide jaws 36 which are of a geometry to withstand large compressive forces applied outwardly on their noses 176 and resisted by support forces occurring primarily at the ridge lines 170 and 172. The ribs 142 also may be of appropriate configuration to provide a slight converging taper of the resulting jaw noses from the upper ends to the lower ends in the terminal 6A, as best seen in FIGS. 10 and 11.

After the final formation of the depressions to form the jaws 36, as in blank 4*d*, the foldable configurations 4 may be shaped in other respects to arrive at the final terminal form of FIG. 8. Among such steps are coining of the angular top surfaces of the jaws (which have resulted from the notches 20) to provide a smooth beveled surface on each jaw for the wire-engaging functions, folding the sides 28 and 30 approximately perpendicularly to the terminal body base 32, folding tabs 174*a*, 174*b*, 174*c* and 174*d* (FIG. 8) into their proper positions, and severing stems 8 and 10 from the metal blank 2. Stem 8 is bent to its bow form, and its distal end 8*a* is bent into a U-shaped configuration, to form the completed terminal 6A. Jaws 36, the completed result of the formative steps performed upon depressions 50, are accordingly disposed along at least one side, and preferably both sides 28 and 30, of the terminal 6A to extend inwardly over the terminal body base panel 32. In the form of the terminal 6A shown in FIG. 8, two pairs of jaws 36 are disposed in the sides 28 and 30 so that the jaws extend toward each other and the tip portions 176 are positioned in opposition to each other.

When the completely formed terminals 6A have been severed from the metal blank 2 and finally formed into their ultimate configurations they may be mounted in a molded, insulating receptacle 178, such as shown in FIG. 9. Without describing the receptacle 178 in great detail, it may be noted that it includes a plurality of generally channel-shaped passages 80 into which the terminals 6A may be inserted. The U-shaped distal end 8*a* of each terminal may be hooked about a rib 182 or 182*a* on one side of receptacle 178 as each of the terminals is inserted into a passage 180, and tabs 174*c* are bent up to the locking portion of FIG. 9. Vertical passages 184 permit access to be had to each channel 34 running through the body of each terminal 64 in a passage 180. The sides 186 of each passage 180 are disposed so that the shoulders 38*a* and 38*b* of each terminal are closely fitted against them, and the shoulders may therefore provide the primary support force transfer from the jaws 36 to the sides 186 for supporting the jaws 36 against outward deformation of the jaws which might otherwise result from forcible insertion of wires against the jaw noses 176. In order to obtain the close fitting engagement of the shoulders against the sides of the passages 180, it is important that the widths of the terminals and the widths of the passages be precisely dimensioned.

Referring now particularly to FIGS. 10 and 11, the insertion into the receptacle of wires to carry electrical current, and fixing them there, normally is accomplished by forcing the wires 188, including a center conductor 189 and an insulation covering 190, laterally of their axes through the vertical passages 184 into the inclined surfaces defined by notches 20 of jaws 36 and between the noses 176. A tool blade 192 is shown above each wire and having an end surface to force each insulation-covered wire between a set of jaws 36. If a plurality of wires 188 are to be inserted substantially simultaneously, the tool may comprise a plurality of blade faces 194. As each ram face 194 is forced downwardly, it forces one wire 188 between jaws 36 of one terminal, and in the course of so positioning wire 188, the insulation 190 is stripped from the wire and the conductor core 189 engages the noses 176 in order to obtain reliable electrical contact between the conductor and the terminal. Shoulders 38*a* and 38*b* by providing compressive support between the side walls of each terminal and the sides 186 of the passages 180 substantially in alignment with the side walls of each respective jaw 36, assist in assuring accurate and rigid positioning of the conductor engaging edges 176 to assure the desired engagement of the jaws with the conductor when a conductor is forced against the jaws.

From the foregoing detailed description it may be ascertained that the present invention includes obtaining additional lengths of metal in and adjacent to, or between, a jaw or set of jaws disposed in at least one of the sides of an electrical terminal. Such additional lengths are produced by coining the metal used in making the terminal and by limiting the stretching of the metal to a gradual and dispersed stretching throughout a substantial portion of the side of the terminal. It may also be ascertained that the base width of the jaws is progressively narrowed to provide rigidity against outward collapse of each jaw outward pressure exerted by disposing electrical wires in the terminal. The shoulders at each side of each jaw insure contact with the side walls of the receptacle passages very near positions of alignment with the jaw sides, thus enhancing the compression strength of the jaws upon the current-carrying wire.

Thus it will be seen that improvements have been provided in the formation of electrical terminals and which meet the aforestated objects.

While a particular embodiment of the present invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A set of progressive dies for forming resiliently biased wire contacting jaws in an electrical terminal comprising:

a first ribbed die face including a plurality of first valleys intermediate the ribs, a first mating die face for engagement upon the first ribbed die face, said first mating die face including a plurality of ribs disposed for engagement into the first valleys on the first ribbed die face, a second ribbed die face including a plurality of second valleys thereon narrower and deeper than said first valleys on the first ribbed die face and first shoulder ribs along the outer edges of the outermost second valleys, a second mating die face for engagement upon the second ribbed die face, said second mating die face including a plurality of second ribs narrower and higher than the ribs on said first mating die face and disposed for engagement into the second valleys on the second ribbed die face, said second mating die face also including a plurality of first shoulder receiving grooves for engagement onto the first shoulder ribs of the second ribbed die face, a third ribbed die face including a plurality of third valleys thereon narrower and deeper than said second valleys and second shoulder ribs of less height than and of lesser radius than the first shoulder ribs in said second die face, and a third mating die face for engagement upon the third ribbed die face, said third mating die face including a plurality of third ribs narrower and higher than the second ribs on said second mating die face and disposed for engagement into the third valleys on the third ribbed die face, said third mating die face also including a plurality of second shoulder receiving grooves for engagement onto the second shoulder ribs of the third ribbed die face.

2. The set of progressive dies of claim 1 which further comprises a first yoke portion in the face of the second ribbed die arranged to interfit with a first mating yoke portion in the second mating die face, said first yoke portion being disposed intermediate the second valleys on the second ribbed die face and said first mating yoke portion being disposed intermediate the ribs on the second mating die face.

* * * * *

UNITED STATES PATENT AND TRADEMARK OFFICE

CERTIFICATE OF CORRECTION

PATENT NO. : 4,027,521

DATED : June 7, 1977

INVENTOR(S) : WILLIAM H. McKEE and ANTHONY E. SCHUBERT

It is certified that error appears in the above-identified patent and that said Letters Patent are hereby corrected as shown below:

Change "4b" to "4d" in Fig. 1, right side

Column 3, line 39, "indicated" should be -- identical --

Column 4, line 11, after "edge" insert -- of --

Column 4, line 54, "cuase" should be -- cause --

Column 5, line 43, after "0.006" insert -- inch --

Column 5, line 53, after "0.006" insert -- inch --

Column 5, line 64, "as" should be -- is --

Column 6, line 11, "steps" should be -- step --

Column 6, line 18, "formations" should be -- formation --

Column 6, line 46, after "0.016" insert -- inch --

Column 6, line 50, after "36" and before "gradually" insert -- (See Figs. 7 and 8) --

Column 7, line 45, after "face" and before "and" insert -- 42 --

Column 8, line 4, "is" should be -- in --

UNITED STATES PATENT AND TRADEMARK OFFICE

CERTIFICATE OF CORRECTION

PATENT NO. : 4,027,521

DATED : June 7, 1977

INVENTOR(S) : WILLIAM H. McKEE and ANTHONY E. SCHUBERT

It is certified that error appears in the above-identified patent and that said Letters Patent are hereby corrected as shown below:

Column 9, line 7, "depression" should be -- depressions --

Column 9, line 10, "pont" should be -- point --

Column 9, line 10, change "3" to -- 4 --

Column 10, line 30, change "respectfully" to -- respectively --

Column 10, line 50, "porjection" should be -- projection --

Column 10, line 59, "porjection" should be -- projection --

Column 11, line 2, before "angled" insert -- are --

Column 11, line 65, "28" should be -- 128 --

Column 13, line 51, "80" should be -- 180 --

Column 14, line 39, after "jaw" insert -- under --

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*